US007451719B1

(12) United States Patent
Fitzpatrick et al.

(10) Patent No.: US 7,451,719 B1
(45) Date of Patent: Nov. 18, 2008

(54) HIGH TEMPERATURE SUPERCONDUCTING DEGAUSSING SYSTEM

(75) Inventors: Brian K. Fitzpatrick, Swedesboro, NJ (US); Thomas H. Fikse, West Chester, PA (US); William A. Lynch, Philadelphia, PA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 25 days.

(21) Appl. No.: 11/788,331

(22) Filed: Apr. 19, 2007

Related U.S. Application Data

(60) Provisional application No. 60/797,084, filed on Apr. 19, 2006.

(51) Int. Cl.
*B63G 9/00* (2006.01)

(52) U.S. Cl. ..... 114/240 R; 62/51.1; 361/143; 361/149

(58) Field of Classification Search ..... 114/240 R, 114/343, 355; 62/6, 51.1, 79, 434; 361/143, 361/146, 147, 149, 267
See application file for complete search history.

(56) References Cited

U.S. PATENT DOCUMENTS

| | | | | |
|---|---|---|---|---|
| 2,267,838 | A * | 12/1941 | Polin | 361/149 |
| 3,110,282 | A * | 11/1963 | Foerster | 114/240 R |
| 4,734,816 | A * | 3/1988 | Guillemin et al. | 361/149 |
| 4,737,174 | A * | 4/1988 | Pontius | 96/138 |
| 4,993,345 | A * | 2/1991 | Feldman | 114/240 R |
| 5,060,481 | A * | 10/1991 | Bartlett et al. | 62/51.2 |
| 5,081,071 | A | 1/1992 | Hirschkoff | |
| 5,463,523 | A * | 10/1995 | Holmes et al. | 361/149 |
| 5,483,410 | A | 1/1996 | Holmes et al. | |
| 5,956,957 | A | 9/1999 | Lowry et al. | |
| 6,347,522 | B1 | 2/2002 | Maguire et al. | |
| 6,415,613 | B1 * | 7/2002 | Ackermann et al. | 62/51.1 |
| 6,640,552 | B1 * | 11/2003 | Rampersad et al. | 62/6 |
| 6,895,765 | B2 | 5/2005 | Bonaquist et al. | |
| 6,965,505 | B1 | 11/2005 | Mack et al. | |
| 7,113,384 | B2 * | 9/2006 | Swinbanks et al. | 361/143 |
| 2007/0006598 | A1 * | 1/2007 | Laskaris et al. | 62/51.1 |

* cited by examiner

*Primary Examiner*—Lars A Olson
(74) *Attorney, Agent, or Firm*—Dave A. Ghatt; Scott R. Boalick

(57) ABSTRACT

A method and apparatus for degaussing a water vessel. The invention involves the use of a light-weight reduced-size degaussing system that comprises a plurality of degaussing coils arranged in a plurality of axes. An electrical current is passed through the plurality of coils to create a degaussing field. The degaussing coils comprise a high temperature superconductor material, the coils cooled by a single-phase gaseous cryogen.

15 Claims, 4 Drawing Sheets

HIGH TEMPERATURE SUPERCONDUCTING DEGAUSSING SYSTEM

CROSS-REFERENCE TO RELATED APPLICATIONS

This application claims the benefit of U.S. Provisional Application No. 60/797,084, filed Apr. 19, 2006, which is incorporated herein by reference.

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a method and apparatus for degaussing a water vessel, and in particular, a light-weight reduced-size degaussing system that utilizes high temperature superconductor cables, and a single phase gaseous cryogen for cooling the high temperature superconductor.

BACKGROUND

Degaussing is a process in which a system of electrical cables is installed around the circumference of ship's hull, running from bow to stem on both sides. A measured electrical current is passed through these cables to cancel out the ship's inherent magnetic field. The degaussing system can be utilized whenever the ship is in waters that might contain magnetic influence mines in order to make the ship "invisible" to the sensors of the magnetic mines.

The basic design of degaussing systems have gone unchanged from WWII thru the present day classes of ships. Since 1950, the U.S. Navy has lost more ships to mines than to missiles, torpedoes, or bombs. Recently, an Advanced Degaussing System (ADS) has been developed. The ADS consists of multiple individually and independently controlled degaussing loops oriented along multiple axes. The ADS can achieve an additional reduction in magnetic signature over presently deployed systems. However, this reduction in signature is accompanied with other penalties such as increased cost and weight.

The need for improved signature reduction technologies is especially urgent in light of the change in the Navy's missions toward littoral zones, and the ever-increasing availability of naval mines that are equipped with improved sensing technologies to accurately target a ship based on its electromagnetic field signature. Systems that have been developed to improve electromagnetic signature reduction come at a cost of increased weight and volume, along with attendant ship fabrication issues. There is a need for a degaussing system that does not include these undesired side-effects.

SUMMARY

In one aspect, the invention is a light-weight reduced-size degaussing system. The system comprises a water vessel having three perpendicular vessel planes, and a plurality of degaussing coil loops running throughout the hull of the water vessel. According to the invention, a plurality of the plurality of degaussing coil loops is arranged substantially parallel to each of the three perpendicular vessel planes. In this aspect, each degaussing coil loop includes a light-weight reduced-size cable assembly. Each cable assembly includes a hollow support tube, a high temperature superconductor cable wrapped around the hollow support tube, with the support tube supporting the high temperature superconductor cable. Each light-weight reduced-size cable assemble further includes a single-phase gaseous cryogen flowing through the hollow support tube for cooling the high temperature superconductor, and a cryogenic tube with an elongated opening. The high temperature cable and the hollow support tube are located within the elongated opening of the cryogenic tube. In this aspect, the invention further includes one or more power sources electrically connected to the plurality of degaussing coil loops for providing electric currents through the degaussing coil loops. The invention also has one or more circulation fans associated with each cable assembly for circulating the single-phase gaseous cryogen, and one or more refrigerators associated with each cable assembly for receiving and cooling the single-phase gaseous cryogen circulated by the one or more circulation fans. In this aspect, the force of the fan directs the cooled single-phase gaseous cryogen from the refrigerator to and through the hollow tube.

In another aspect, the invention is a method of degaussing a water vessel having three vessel planes. The method includes the providing of a plurality of degaussing coil loops running throughout the hull of the water vessel, with a plurality of the plurality of degaussing coil loops arranged substantially parallel to each of the three perpendicular vessel planes. According to the instant method, each degaussing coil loop comprises a light-weight reduced-size cable assembly. The cable assembly has a hollow support tube, a high temperature superconductor cable wrapped around the hollow support tube, with the support tube supporting the high temperature superconductor cable. The cable assembly further includes a cryogenic tube with an elongated opening, wherein the high temperature cable and the hollow support tube are located within the elongated opening of the cryogenic tube. In this aspect, the method further includes the cooling of the single-phase gaseous cryogen that is circulated in each degaussing coil loop. The method also includes the circulating of electrical currents through each of the plurality of degaussing coil loops. In this aspect, the method further includes the circulating in each degaussing coil loop, a single-phase gaseous cryogen through the inner core of each hollow support tube to cool each high temperature superconductor cable.

In another aspect, the invention is a light-weight reduced-size degaussing system. The system comprises a water vessel having three perpendicular vessel planes, and a plurality of degaussing coil loops running throughout the hull of the water vessel. According to the invention, a plurality of the plurality of degaussing coil loops is arranged substantially parallel to each of the three perpendicular vessel planes. In this aspect, each degaussing coil loop includes a light-weight reduced-size cable assembly. According to the invention, each cable assembly comprises a high temperature superconductor and a cryogenic tube with an elongated opening. The high temperature cable is located within the elongated opening of the cryogenic tube. The system further includes a single-phase gaseous cryogen flowing through the elongated opening in the cryogenic tube for cooling the high temperature superconductor. In this aspect, the system further includes one or more power sources electrically connected to the plurality of degaussing coil loops for providing electric currents through said degaussing coil loops. Additionally, the system has one or more circulation fans associated with each cable assembly for circulating the single-phase gaseous cryogen, and one or more refrigerators associated with each cable assembly for receiving and cooling the single-phase gaseous cryogen circulated by the one or more circulation fans. In this aspect, the force of the fan directs the cooled single-phase gaseous cryogen from the refrigerator to and through the hollow tube.

BRIEF DESCRIPTION OF THE DRAWINGS

Other features will be apparent from the description, the drawings, and the claims.

DETAILED DESCRIPTION

Figure 1A:
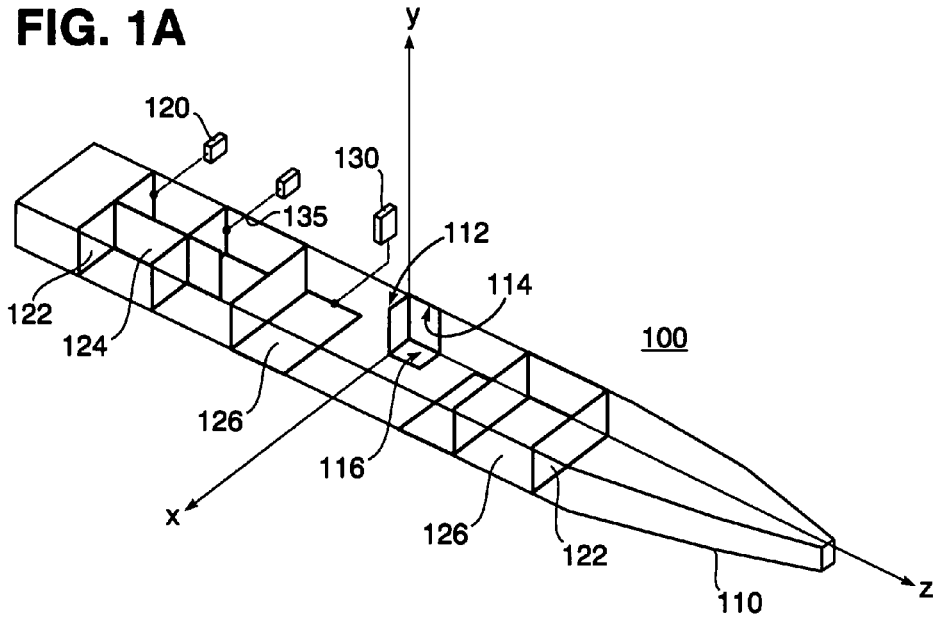
FIG. 1A is a schematic illustration of a High Temperature Superconducting Degaussing System (HTSDS) according to an embodiment of the invention.
Figure 1B:
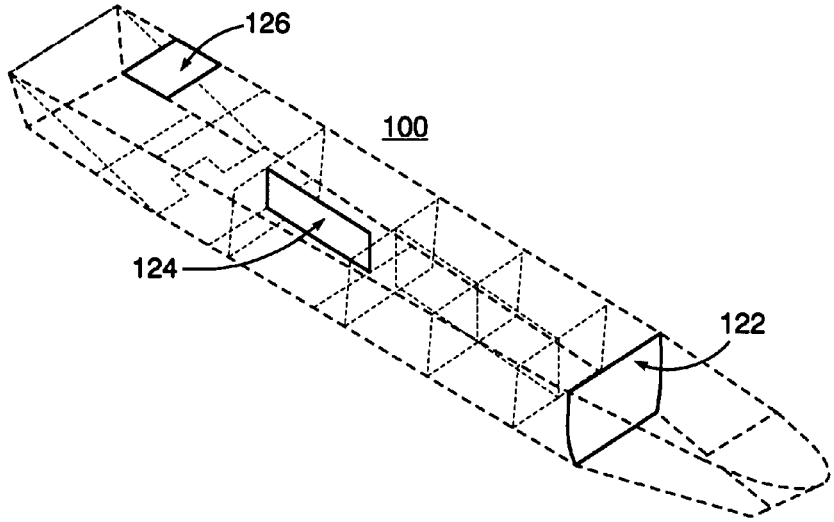
FIG. 1B is a schematic illustration of an array of high temperature superconducting degaussing coils according to an embodiment of the invention.

Disclosed is a High Temperature Superconducting Degaussing System (HTSDS) for water vessels such as naval ships. An HTSDS is small, light-weight, reduced-size, and has a lower installation cost than present Advanced Degaussing Systems. FIG. 1A is a schematic illustration of a HTSDS 100 according to an embodiment of the invention. As shown, the system 100 is applied to a water vessel 110 having three perpendicular vessel axes, x, y, and z. FIG. 1A also illustrates a vessel plane 112 aligned along the x-y axes, a vessel plane 114 aligned along the y-z axes, and a vessel plane 116 aligned along the z-x axes. As shown in FIG. 1A, the system 100 further includes a plurality of coils 122 positioned substantially parallel to plane 112, and a plurality of coils 124 positioned substantially parallel to plane 114. The system 100 also includes coils 126 positioned substantially parallel to plane 116. The coils 122, 124, and 126 are positioned throughout the hull of the water vessel 110, and the locations and sizes of these coils may vary. FIG. 1B is a schematic illustration of an array of high temperature superconducting degaussing coils according to an embodiment of the invention, and schematically shows a more comprehensive array of coils.

The degaussing coils 122, 124, and 126 are connected to a power source 130, via a power feeder 135. The system 100 may include a plurality of power sources 130 for providing electrical currents to the plurality of coils 122, 124, and 126. One power source 130 may be associated with one or more coils. Alternatively, depending on energy requirements, a plurality of sources may be associated with a single degaussing coil. The current flowing through the plurality of coils 122, 124, and 126 combine to create a magnetic field to counteract the ship's vertical, longitudinal and athwartship magnetization, respectively.

Figure 2:
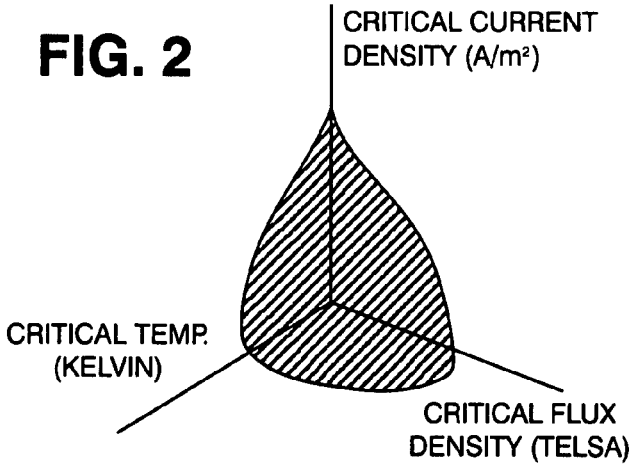
FIG. 2 is a graphical illustration showing conductivity as a function of temperature.
Figure 2:
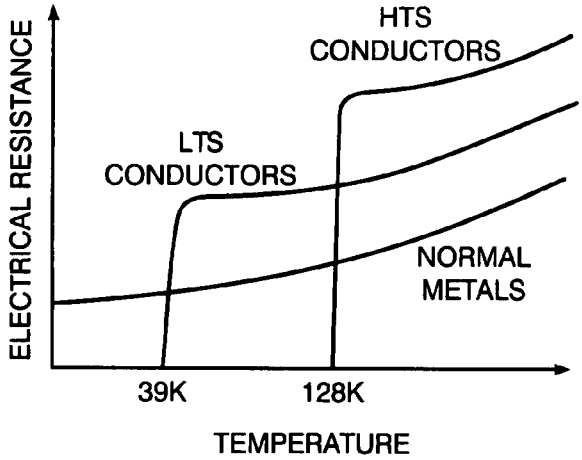

According to the instant invention, superconducting cable technology is used to reduce the negative impacts of the Advanced Degaussing System (ADS) to ship design and construction while maintaining or increasing its performance. Superconductivity is a phenomenon whereby a material will transition from a resistive state to a perfect conductor of electricity. As shown in FIG. 2, this transition will occur suddenly and is governed by the materials' temperature, current density, and magnetic flux density. A High Temperature Superconductor (HTS) is a conductor that is typically a mixed state superconductor composed of material having no resistance linked by material having electrical resistivity. Electric fields and, therefore, voltage drops exist in HTS wires/cables when they are operated at useful currents. But these voltages, and the resistances that cause them, are very small compared to copper, aluminum, silver or any other conducting material operating at the same current, fields, and temperatures. HTS wires/cables cooled to cryogenic temperatures can be operated at current densities that are a factor of 100 to 200 higher than that of room temperature conductors. This allows magnets to be fabricated with HTS wire that are a fraction of the weight of room temperature magnets producing the same magnetomotive force (MMF) and magnetic flux. The advantage of an HTS magnet system over one based on low temperature superconductors (LTS) is the reduced cryogenic refrigeration required to maintain the HTS system at temperature. The maximum operating temperature for a practical LTS magnet is below 15 K. HTS magnets have been designed and built to operate at 77K, the temperature of liquid nitrogen (at 1 atm), and an easy to handle liquid cryogen. However, HTS wires operating at temperatures lower than 77K, using gaseous helium as a cooling medium, are capable of even higher current densities.

Replacing the copper conductor cabling in a typical degaussing system with a superconducting cable offers the benefits of both reduced conductor weight and reduced number of conductor turns. Superconducting materials to be used in the instant invention may include, Magnesium Diboride (MgB2), Yttrium Barium Copper Oxide (YBCO), Bismuth Strontium Calcium Copper Oxide (BSCCO). The BSCCO may take each of two known molecular forms, Bi2223 and Bi2212. The benefits of using a high temperature superconductor may be demonstrated by using, for example, Bi2223. At a temperature of 30 to 40K (−243° C. to −233° C.), Bi2223 can operate at a current density of 25,000 to 30,000 A/cm2 (160,000 to 190,000 A/in2). This represents a current density that is more than a factor of 150 to 190 higher than the operating current density of the copper conductor in the ADS. The HTS reduces the average loop conductor weight from 1100 kg (2400 lbs) to approximately 11 kg (24 lbs). In addition, the typical conductor operating current may be increased an order of magnitude over the present ADS (e.g., HTS current could be 200 Amps if at 50K while the present conductor current is below 20 Amps).

The effect of increased conductor current on cable sizing is dramatic. When used in a flexible cryogenic tube at a 200 Amp current level, only 19 HTS cables are required to produce the same magnetomotive force as 224 copper conductors in multiple cables at a 17 Amp current level. In addition, this operating current and magnetomotive force can be achieved in the HTSDS with a power supply having a voltage rating of 5V or less—compared to the several hundred volts currently required by copper conductors based systems because there is no voltage drop within the superconducting cable. The only voltage drop is present within the power supply and the leads from the power supply to the cryogenic region.

The reduction in cable size that is possible with the superconducting cable provides additional installation benefits since, for most degaussing loops, only one physical turn of its flexible cryostat is required. Installation benefits are also achieved with reduced power supply electrical requirements and reduced size and weight of the power supply system.

Figure 3A:
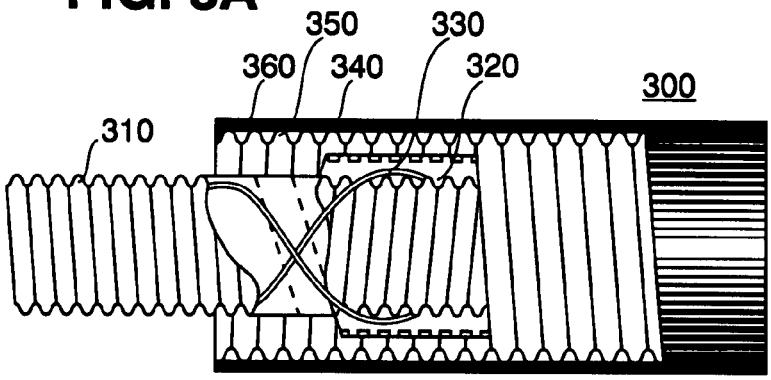
FIG. 3A is an exemplary cross section of a cryogenic tube used for a high temperature superconductor (HTS) cable application according to an embodiment of the invention.

As outlined above, high temperature superconductors require the use of at least one cryogenic refrigeration system. Cryogenic refrigeration systems typically allow a wide range of operating temperatures (i.e., from 35K through 80K). Because the degaussing system discussed herein is superconducting, the appropriate cryogenic environment must be maintained at all times around the distributed cable system. FIG. 3A is an exemplary cross section of a cryogenic tube used for a high temperature superconductor (HTS) cable application according to an embodiment of the invention. FIG. 3A shows a cryogenic tube 300 that includes a first corrugated stainless steel tube 310, a super insulation layer 320 surrounding the first tube 310, and a spacer layer 330 surrounding the super insulation layer 320. FIG. 3A also shows, a second corrugated stainless steel tube 340, and vacuum space 350 located between the second corrugated stainless steel tube 340 and the spacer layer. FIG. 3A also illustrates an outer protective layer 360.

Figure 3B:
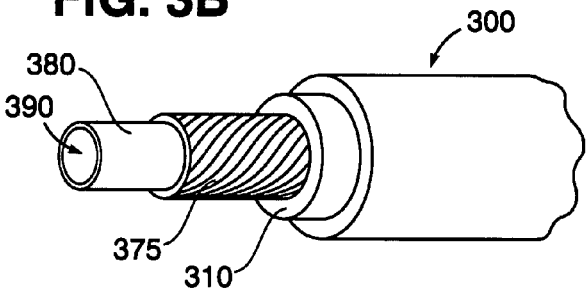
FIG. 3B is an exemplary illustration of a light-weight reduced-size cable assembly according to an embodiment of the invention.

FIG. 3B is an exemplary illustration of a light-weight reduced-size cable assembly according to an embodiment of the invention. As shown, FIG. 3B essentially shows the HTS inserted into the cryogenic tube of FIG. 3A. FIG. 3B shows the cryogenic tube 300 including the aforementioned layers with the HTS cable 375 inserted into the first corrugated stainless steel tube 310. As shown, the cable 375 is wrapped around a hollow support tube 380, which supports the cable 375. The cable assembly can be for example, from approximately 50 meters to hundreds of meters long. An arrow 390 points to the hollow section of the support tube 380 where a single-phase gaseous cryogen is passed for cooling the HTS cable.

Figure 3C:
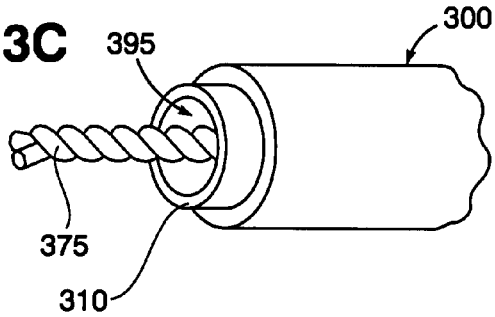
FIG. 3C is an exemplary illustration of a light-weight reduced-size cable assembly according to an embodiment of the invention.

FIG. 3C is an exemplary illustration of a light-weight reduced-size cable assembly according to another embodiment of the invention. As shown, FIG. 3C shows the cryogenic tube 300 including the aforementioned layers with the HTS cable 375 inserted into the first corrugated stainless steel tube 310. The embodiment illustrated in FIG. 3C does not include a hollow support cable as illustrated in FIG. 3B. The HTS cable 375 in FIG. 3C is may be a plurality of HTS cables wrapped together. The cable 375 may be free-floating throughout the elongated opening of the first corrugated stainless steel tube 310. Alternatively, the cable 375 may be secured to a circumferential wall inside the stainless steel tube 310. An arrow 395 points to the elongated opening in the first corrugated tube where a single-phase gaseous cryogen is passed for cooling the HTS cable.

The choice of cryogenic fluid for the apparatus depends on the desired operating temperature of the cable. Superconducting cables with a working fluid temperature between about 40K and about 65K offer significant advantages in power density and weight savings. Gaseous helium has a wide operating range and is works well at the operating aforementioned operating temperatures. Gaseous helium has the additional benefit of being an inert gas. As illustrated in FIG. 2, a property of superconductivity is that the lower the temperature of the superconductor, the more current it is able to carry. According to the invention, cables such as cable 375 may carry about 3,000 Amps and higher, at voltages of up to 138 kV.

Figure 4:
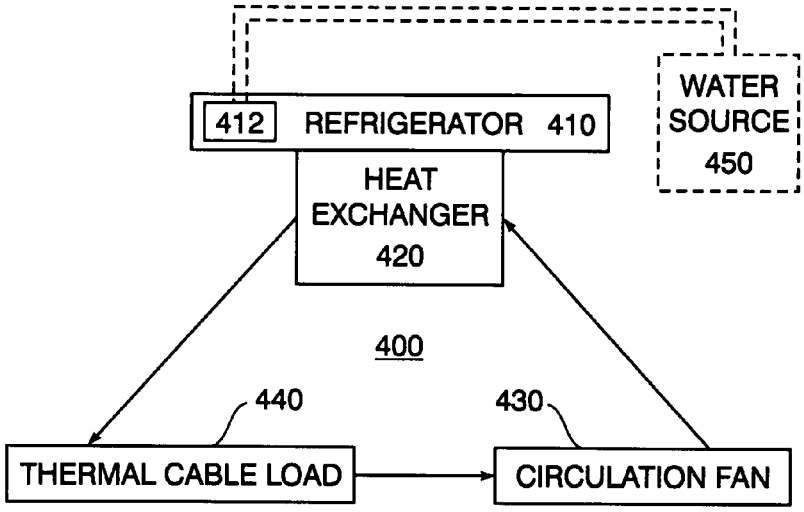
FIG. 4 is an exemplary schematic diagram of a cooling loop.

FIG. 4 is an exemplary schematic of a cooling loop according to the invention. According to the invention, a cooling loop may be provided for each degaussing coil. As illustrated, the cooling loop 400 includes at least one refrigerator 410, a heat exchanger 420, and a circulation fan 430. The thermal cable load is represented as 440. In operation, the single-phase gas flows through the circulation fan 430, and is cooled in the heat exchanger 420. The cooled gas then collects heat dissipated by the cable load 440, thereby cooling the cable. The heated gas is cooled again by the heat exchanger 420. As outlined above, because of operation temperatures between about 40K and about 65K, helium is preferably used as the single-phase gas.

The cooling loop 400 may optionally utilize cooling water from a source 450. The source may be connected to a heat exchanger 412 within the refrigerator 410. The source 450 may provide chilled water or seawater. To reduce the impact to the ship, seawater cooling typically is preferred. In one implementation, the cryogenic systems run on 105° F. inlet water with no degradation in cooling capacity. If seawater is used, the seawater may be pumped from overboard, treated if necessary, and then conveyed to the cooling loop. It should be noted that the temperature of the cables determine how much cooling is required. Depending on the cooling load required, there may be more than one cryogenic refrigerator per loop. The number of cryogenic refrigerators also depends on the size of the water vessel. For example, a ship of about 36,000 cubic feet may require between 40 and 180 cryogenic refrigerators to service the plurality of degaussing coils. Alternatively, as opposed to the cooling loop 400, open looped cooling may be considered if the gas is used for another application such as a fuel. For example, a cryogenic gas such as helium or neon could first cool a superconductor, then a power electronic device, then a passive filter device, then a motor, and finally a high power contactor.

Figure 5:
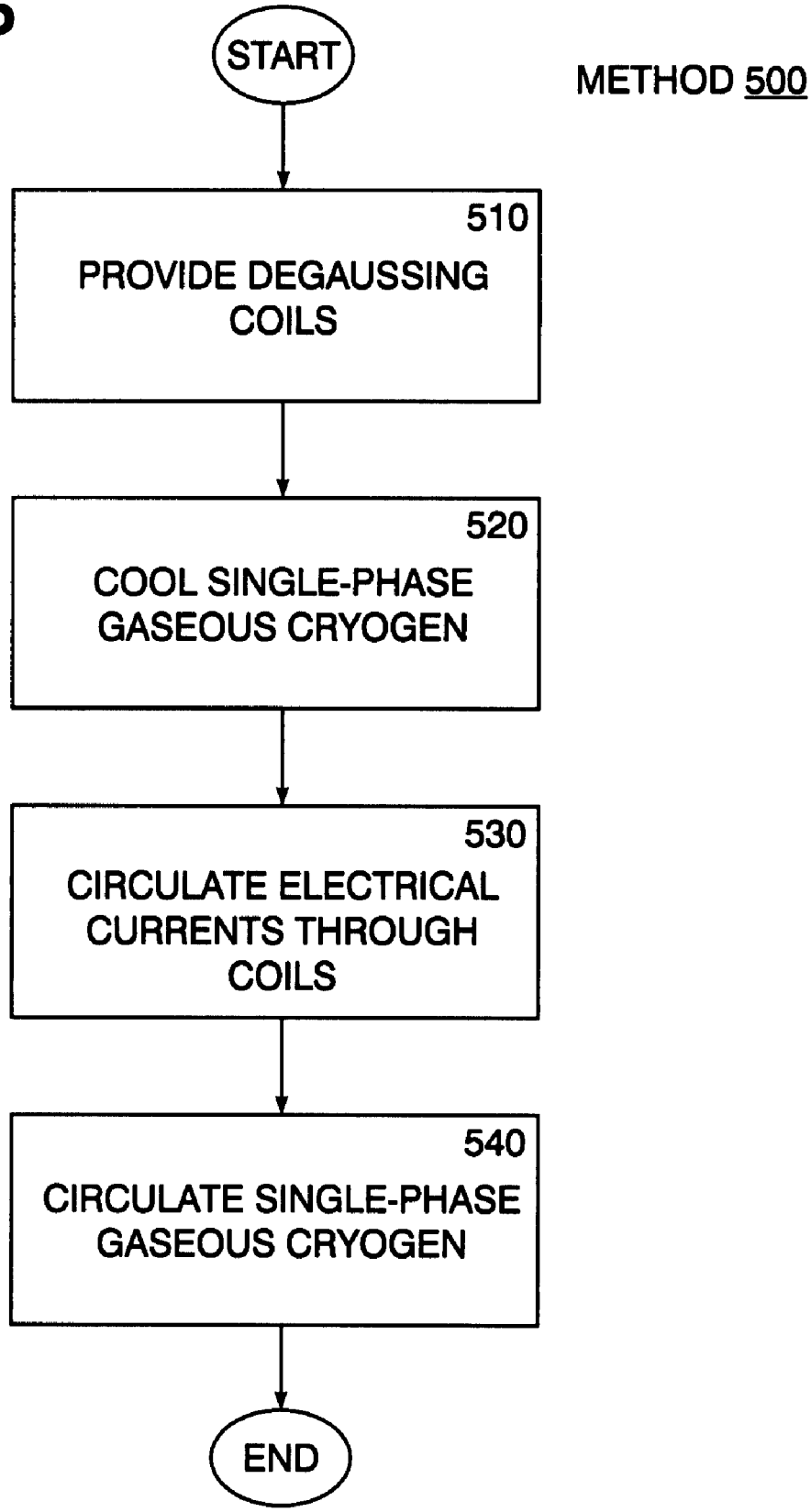
FIG. 5 is a flowchart illustrating a method of degaussing a water vessel according to an embodiment of the invention.

FIG. 5 outlines a method 500 of degaussing a water vessel according to an embodiment of the invention. According to the method, step 510 is the providing of a plurality of degaussing coils running throughout the hull of the vessel. As illustrated in FIGS. 1A and 1B, a plurality of degaussing coils are aligned parallel to each of three vessel planes. As shown in FIGS. 3A and 3B, each degaussing coil comprises a light-weight reduced-size cable assembly. Each cable assembly includes a high temperature superconductor cable wrapped around a support tube, the HTS cable and support tube held within a cryogenic tube. Alternatively, as shown in FIG. 3C, the HTS cable may be provided as a plurality of cables wrapped together, without a support tube. In this embodiment, the HTS cable may be attached free-floating in an elongated opening in the cryogenic tube, or the HTS cable may be attached to an inner circumferential wall in the cryogenic tube. According to the method, the HTS cable may be Magnesium Diboride (MgB2), Yttrium Barium Copper Oxide (YBCO), Bismuth Strontium Calcium Copper Oxide (BSCCO), combinations thereof, or other known HTS substances. The BSCCO may take each of two known molecular forms, Bi2223 and Bi2212.

Step 520 is the cooling of the single-phase gaseous cryogen. One or more refrigerators are used to cool the single-phase gaseous cryogen. One or more heat exchangers may be associated with the refrigerator to provide the cooling. Additionally, chilled water or seawater may be introduced into the cooling loop.

Step 530 is the circulating of electrical currents through each of the plurality of degaussing coil loops. As shown in FIG. 1A, one or more power sources provide the requisite electrical energy. Step 540 is the circulating of a single-phase gaseous cryogen through the inner core of the hollow tube. In the embodiment illustrated in FIG. 3C, the single-phase gaseous cryogen may be circulated through the elongated opening in a first corrugated steel tube. As outlined above, helium is preferably used as the single-phase gaseous cryogen. As shown schematically in FIG. 4, one or more fans are provided for circulating the gas.

The instant invention provides many advantages over conventional degaussing systems. These advantages include improved load carrying capacity, reduced weight, and reduced costs associated with the invention. A comparison of the HTSDS to the conventional copper based system was made. The HTS cable allows fewer cables to be used to accomplish the same goal as current copper cables. A reduction in cable size reduces the time for cable installation. Depending upon the HTS cable size, the number of cable connections may be reduced in ranges from 3-4 times to an order of magnitude. This reduction in size results in a reduction in installation time and post cable-pulling quality assurance tests to check if the cable is damaged. Another benefit is a reduction in the conduit size and weight that is used to traverse tanks and voids. Not only is there a reduction in the amount of conduit used, but also a reduction in installation cost of the conduit and a reduction in its associated weight. A comparison of the weight of the existing system and an HTSDS was also performed. The HTS cable typically is at least 15 times lighter than the equivalent amount of copper cable. Even when accounting for the weight of all support systems, the HTSDS is still typically at least 15 times lighter than the copper cable degaussing system on a large amphibious ship—this represents a weight reduction nearly 50 tons just for the cable.

The last part of the comparison is the power supply used by each system. The AC to DC power supply in the existing copper system will have a higher voltage and power rating than that required by an HTSDS system. One advantage of the lower power rating is the corresponding reduction in size and weight of the HTSDS power supply. It may be, for example, approximately 5 times lighter than the existing power supply. Taking the support systems of both the conventional and HTSDS degaussing systems into account, the weight of the HTSDS is approximately five (5) times less than the weight of the existing copper system. The actual weight difference is may be over 100 tons for a large amphibious ship.

What has been described and illustrated herein are preferred embodiments of the invention along with some variations. The terms, descriptions and figures used herein are set forth by way of illustration only and are not meant as limitations. For example, FIG. 1A shows less than five degaussing coils in each of the three vessel plans. However, the illustration is directed to illuminate the teaching that degaussing coils are provided in each of the three planes as opposed to teaching an exact number of coils. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A light-weight reduced-size degaussing system comprising:

a water vessel having three perpendicular vessel planes;

a plurality of degaussing coil loops running throughout a hull of the water vessel, with a plurality of said plurality of degaussing coil loops arranged substantially parallel to each of said three perpendicular vessel planes, wherein each degaussing coil loop comprises a light-weight reduced-size cable assembly, each cable assembly comprising:

a hollow support tube;

a high temperature superconductor cable wrapped around the hollow support tube, the support tube supporting the high temperature superconductor cable;

a single-phase gaseous cryogen flowing through the hollow support tube for cooling the high temperature superconductor;

a cryogenic tube with an elongated opening, wherein the high temperature cable and the hollow support tube are located within the elongated opening of the cryogenic tube;

one or more power sources electrically connected to said plurality of degaussing coil loops for providing electric currents through said degaussing coil loops;

one or more circulation fans associated with each cable assembly for circulating the single-phase gaseous cryogen; and one or more refrigerators associated with each cable assembly for receiving and cooling the single-phase gaseous cryogen circulated by said one or more circulation fans, wherein the force of the fan directs the cooled single-phase gaseous cryogen from the refrigerator to and through the hollow tube.

2. The light-weight reduced-size degaussing system of claim 1 wherein the single-phase gaseous cryogen comprises helium.

3. The light-weight reduced-size degaussing system of claim 2, wherein the high temperature superconductor cable comprises bismuth, and operates at a temperature between 40K and 65K.

4. The light-weight reduced-size degaussing system of claim 3, wherein the high temperature superconductor is bismuth strontium calcium copper oxide.

5. The light-weight reduced-size degaussing system of claim 4, further including one or more water conduits attached to the one or more refrigerators, the water conduits attached to a pump for the intake of sea-water to be used as a coolant.

6. The light-weight reduced-size degaussing system of claim 1 wherein the cryogenic tube further comprises:

a first corrugated stainless steel tube having an elongated opening within which the high temperature cable and the hollow support tube are located;

a super insulation layer surrounding the first corrugated stainless steel tube;

a spacer layer surrounding the insulation layer;

a second corrugated stainless steel tube surrounding the spacer layer, with a vacuum space between the second corrugated stainless steel tube and the spacer layer; and a protective outer layer surrounding said second stainless steel tube.

7. A method of degaussing a water vessel having three vessel planes, the method comprising:

providing a plurality of degaussing coil loops running throughout a hull of the water vessel, with a plurality of said plurality of degaussing coil loops arranged substantially parallel to each of said three perpendicular vessel planes, wherein each degaussing coil loop comprises a light-weight reduced-size cable assembly, the cable assembly comprising:

a hollow support tube;

a high temperature superconductor cable wrapped around the hollow support tube, the support tube supporting the high temperature superconductor cable;

a cryogenic tube with an elongated opening, wherein the high temperature cable and the hollow support tube are located within the elongated opening of the cryogenic tube;

the method further comprising:

cooling a single-phase gaseous cryogen that is circulated in each degaussing coil loop;

circulating electrical currents through each of said plurality of degaussing coil loops; and circulating in each degaussing coil loop, a single-phase gaseous cryogen through an inner core of each hollow support tube to cool each high temperature superconductor cable.

8. The method of degaussing a water vessel of claim 7, further including:

providing one or more circulation fans for circulating the single-phase gaseous cryogen; and providing one or more refrigerators for receiving and cooling the single-phase gaseous cryogen circulated by the one or more fans, wherein the force of the one or more fans direct the cooled single-phase gaseous cryogen from the refrigerator to and through the hollow support tube.

9. The method of degaussing a water vessel of claim 8, wherein the single-phase gaseous cryogen comprises helium.

10. The method of degaussing a water vessel of claim 9, wherein the high temperature superconductor cable comprises bismuth, and wherein the helium cools the high temperature superconductor cable to a temperature between about 40K and about 65K.

11. The method of degaussing a water vessel of claim 10, wherein the high temperature superconductor is bismuth strontium calcium copper oxide.

12. A light-weight reduced-size degaussing system comprising:

a water vessel having three perpendicular vessel planes;

a plurality of degaussing coil loops running throughout a hull of the water vessel, with a plurality of said plurality of degaussing coil loops arranged substantially parallel to each of said three perpendicular vessel planes, wherein each degaussing coil loop comprises a light-weight reduced-size cable assembly, each cable assembly comprising:

a high temperature superconductor;

a cryogenic tube with an elongated opening, wherein the high temperature cable is located within the elongated opening of the cryogenic tube;

a single-phase gaseous cryogen flowing through the elongated opening in the cryogenic tube for cooling the high temperature superconductor;

one or more power sources electrically connected to said plurality of degaussing coil loops for providing electric currents through said degaussing coil loops;

one or more circulation fans associated with each cable assembly for circulating the single-phase gaseous cryogen; and one or more refrigerators associated with each cable assembly for receiving and cooling the single-phase gaseous cryogen circulated by said one or more circulation fans, wherein the force of the fan directs the cooled single-phase gaseous cryogen from the refrigerator to and through the hollow tube.

13. The light-weight reduced-size degaussing system of claim 12 wherein the single-phase gaseous cryogen comprises helium.

14. The light-weight reduced-size degaussing system of claim 13, wherein the high temperature superconductor is Bi2223.

15. The light-weight reduced-size degaussing system of claim 14 wherein the cryogenic tube further comprises:

a first corrugated stainless steel tube having the elongated opening within which the high temperature cable is located;

a super insulation layer surrounding the first corrugated stainless steel tube;

a spacer layer surrounding the insulation layer;

a second corrugated stainless steel tube surrounding the spacer layer, with a vacuum space between the second corrugated stainless steel tube and the spacer layer; and a protective outer layer surrounding said second stainless steel tube.

* * * * *